United States Patent [19]

Higashio et al.

[11] Patent Number: 5,010,363

[45] Date of Patent: Apr. 23, 1991

[54] IMAGE FORMING APPARATUS HAVING SHEET JAM REACTION RESET MEANS

[75] Inventors: Kimihiko Higashio, Osaka; Takeshi Yoshikai, Minokamo, both of Japan

[73] Assignee: Minolta Camera Kabushiki Kaisha, Osaka, Japan

[21] Appl. No.: 459,122

[22] Filed: Dec. 29, 1989

[30] Foreign Application Priority Data

Dec. 30, 1988 [JP] Japan ..... 63-333169
Dec. 30, 1988 [JP] Japan ..... 63-333171

[51] Int. Cl.[5] ..... G03G 15/00

[52] U.S. Cl. ..... 355/206; 355/207; 355/316

[58] Field of Search ..... 355/206, 205, 308, 309, 355/313, 316, 319, 320, 207

[56] References Cited

U.S. PATENT DOCUMENTS

| | | | |
|---|---|---|---|
| 4,090,787 | 5/1978 | Hubbard et al. | 355/206 X |
| 4,176,941 | 12/1979 | Breitenkam et al. | 355/206 |
| 4,247,193 | 1/1981 | Kaneko et al. | 355/206 X |
| 4,260,904 | 4/1981 | Horie et al. | 307/113 |
| 4,449,813 | 5/1984 | Kikuchi et al. | 355/206 |
| 4,477,178 | 10/1984 | Furuichi et al. | 355/206 |
| 4,497,569 | 2/1985 | Booth | 355/206 |

*Primary Examiner*—R. L. Moses
*Attorney, Agent, or Firm*—Willian Brinks Olds Hofer Gilson & Lione

[57] ABSTRACT

An image forming apparatus has a sheet handling section for receiving sheets printed at a copying machine, which is operable in a mode of ejecting printed sheets outside and in a mode of collecting printed sheets inside thereof to process the sheets. The apparatus comprises a sheet path located inside the apparatus, which is openable so that a jammed sheet can be removed; an outside cover which is openable so that an operator can gain access to the sheet path; a sensor for detecting whether the outside cover is in an open state or a closed state; a jam detector for detecting the occurrence of a sheet jam at each part in the sheet path; a jam reacting device; a jam reaction resetting device; and a mode selector. The jam reaction resetting device is operable in a first jam reaction react mode wherein the jam reaction resetting operation is executed in response to an outside cover close signal generated from the outside cover sensor, and in a second jam reaction reset mode wherein the jam reaction resetting operation is executed in response to the recovery of the sheet path from the sheet jam. The mode selector selects either the first jam reaction reset mode or the second jam reaction reset mode beforehand.

5 Claims, 9 Drawing Sheets

40
50
60
70
70a
SE1
61b
26
61a
65
62
77
75
72
69
74
73a
73
80
70b
71
73b
78
70c
2
89
51
76
79
82
SE2
66
30
92
c
79a
94
91b
91
91a
95a
170
116
179
123
SE3
163
99
122
165
93
120
160
105
100
95
90
161
125
110
121
SE9
125a
M1
124
97
d
98
SE4
159
97a
141
117
M2
140
130
143
5
153
131
152
151
132
142
151

IMAGE FORMING APPARATUS HAVING SHEET JAM REACTION RESET MEANS

BACKGROUND OF THE INVENTION

1. Field of the Invention

The present invention relates to an image forming apparatus, and more specifically, an image forming machine provided with a sheet storing unit which is useful for a duplex/composite copying operation.

2. Description of Related Art

In response to an increasing demand for the automation of a copying process, a sheet storing apparatus such as a sheet refeeder which is used for a duplex/composite copying operation and a finisher having a stapling function or a clipping function has been developed into various types which are of practical use.

However, in such a sheet storing apparatus, a sheet jam is inevitable, and the occurrence of a sheet jam is ordinarily detected by a combination sheet sensor and Limer unit. When the occurrence of a sheet jam is detected, a sheet jam reacting operation is executed by putting the copying system out of operation, and the jammed sheet is removed. Thereafter, when reset means such as a switch for detecting a front door open and closed, a switch for detecting a sheet storing apparatus ready, or the like is actuated, a sheet jam reaction resetting operation is executed by resetting every counter and every flag in a microcomputer and canceling the discontinuance of the copying system.

Conventionally, such a sheet storing apparatus does not have an exclusive jam reaction reset switch, and the sheet jam reaction resetting operation is executed in response to an on signal generated from a switch for detecting an outside frame of the sheet storing apparatus open and closed. An operator has to open the outside frame in order to remove a jammed sheet, so that when the operator closes the frame, and thereby the open/closed detection switch is turned on, it may be judged that the jammed sheet has been removed.

However, in reference to a sheet storing apparatus which is operable in a mode wherein copies are ejected onto a sheet tray or copies are transported to a sorter respectively, when a sheet jam takes place around the ejection port, an operator only has to pull out the jammed sheet because the ejection port protrudes outside. Even in this case, in order to start the jam reaction resetting operation, the operator has to open and close the outside frame, which is unnecessary for removing the jammed sheet.

Meanwhile, there has been popularized a copying system which is provided with or is optionally supplied with a sheet refeeder for feeding copy sheets, each of which gained an image on one side in the body of a copying apparatus and ejected therefrom, back to the body for a duplex or composite copying operation. Some copying systems have sheet refeeders, and the others do not. Further, regarding copying systems provided with sheet refeeders, some of them have switches for detecting the sheet refeeder recovering from a sheet jam, and the others do not. Therefore, the best way of executing the sheet jam reaction resetting operation is different from type to type. It is, however, difficult to compose a program by which the system is controlled in every case, and also it is very troublesome to compose different programs according to the existence of each jam reaction reset means.

SUMMARY OF THE INVENTION

It is, therefore, an object of the present invention to provide an image forming apparatus wherein, when a sheet jam occurs in such a part as the jammed sheet can be easily removed therefrom, the reaction to the sheet jam is canceled automatically in response to the removal of the jammed sheet.

It is another object of the present invention to provide an image forming apparatus wherein only one program is necessary to control each jam reaction resetting means so that the effectiveness of the body of the apparatus may be improved.

In order to attain the above-described objects, an image forming apparatus according to the present invention comprises an image forming section for forming an image on a sheet; a sheet handling section for receiving printed sheets from the image forming section, the sheet handling section being operable in an ejection mode of ejecting printed sheets outside and in a mode of collecting printed sheets inside thereof to process the sheets; means provided in the sheet handling section for detecting a sheet, which means is disposed in a sheet path taking sheets outside said sheet handling section; means for detecting the occurrence of a sheet jam at each part in the sheet handling section; means for reacting to a sheet jam by discontinuing the operation of the apparatus in response to a jam signal generated from the sheet jam detecting means; and means for resetting the sheet jam reaction by canceling the discontinuance of the operation; when the apparatus is relieved of the sheet jam, in accordance with the operation mode in which the sheet handling section was operated before the discontinuance, wherein the operation mode of the sheet handling section before the discontinuance is the ejection mode, the jam reaction resetting operation is executed in response to a signal indicating that the sheet detecting means does not detect a sheet after the jam reacting operation.

With the constitution above, the occurrence of a sheet jam at the sheet ejection port is detected by sheet jam detecting means such as composed of a sensor and a timer. In this case, the jammed sheet is pulled out of the ejection port by an operator, so that the apparatus will be relieved of the sheet jam. The sheet detecting means disposed at the ejection port detects the jammed sheet being pulled out thereof, when the detecting means is turned off, and the jam reaction resetting operation is executed automatically in response to this off signal. Accordingly, the operator does not have to open the outside frame for the purpose of starting the jam reaction resetting operation.

Further, an image forming apparatus according to the present invention comprises a sheet path located inside the image forming apparatus, the sheet path being openable so that a jammed sheet can be removed therefrom; an outside cover having an open state so that an operator can gain access to the sheet path, and a closed state; means for detecting whether the outside cover is in the open state or the closed state; means for detecting the occurrence of a sheet jam at each part in the sheet path; means for reacting to a sheet jam by discontinuing the operation of the apparatus in response to a jam signal generated from the sheet jam detecting means; means for resetting the sheet jam reaction, when the apparatus is relieved of the sheet jam, by canceling the discontinuance of the operation, the sheet jam reaction resetting means being operable in a first jam reaction reset mode wherein the jam reaction resetting operation is executed in response to an outside cover close signal generated from the outside cover detecting means, and in a second jam reaction reset mode wherein the jam reaction resetting operation is executed in response to the recovery of the sheet path from the sheet jam; and means for selecting either the first jam reaction reset mode or the second jam reaction reset mode in advance.

With the constitution above, the jam reaction resetting operation is performed in either the first or the second jam reaction reset mode which was selected by the mode selecting means. For example, in the case that the sheet path has an upper guide member and a lower guide member and is of either a type whose upper guide member is openable upward or a type whose lower guide member is openable downward, when the former type of sheet path is attached to the apparatus, the first jam reaction reset mode is selected. On the other hand, when the latter type of sheet path is attached to the apparatus, the second jam reaction reset mode is selected.

With the mode selection means, a jam reaction reset mode which is proper for the type of the sheet path is selected, so that the effectiveness of the whole apparatus is improved, and only one program is necessary to reset every means for reacting to a sheet jam.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE PREFERRED EMBODIMENT

Figure 1:
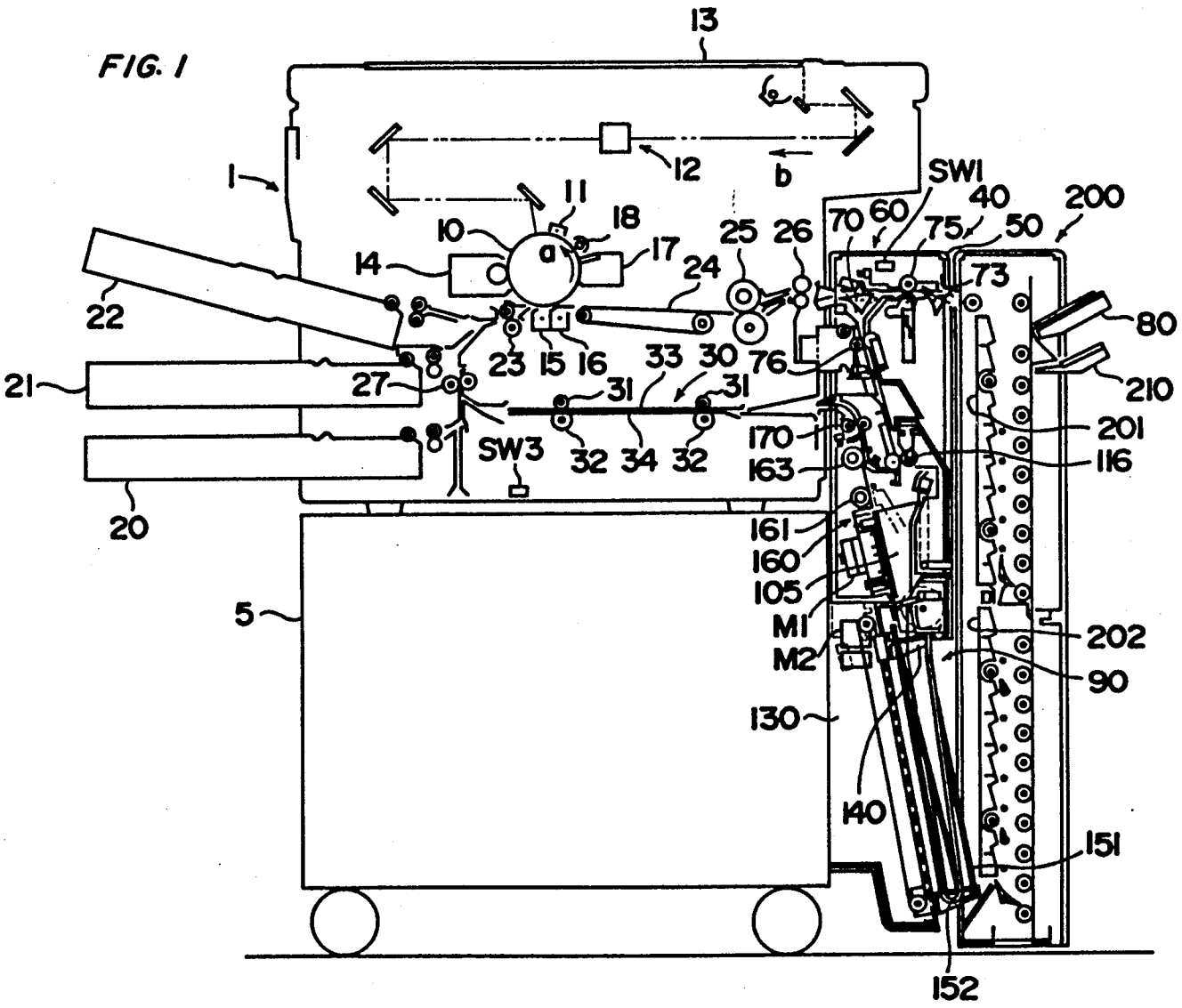
FIG. 1 is a schematic block diagram showing a sheet storing/refeeding unit, including a copying machine, according to the present invention.

An embodiment of the present invention will now be described with reference to the accompanying drawings. The following description will be given in connection with an image forming apparatus provided with a sheet storing/refeeding unit between a copying machine and a sorter.

COPYING MACHINE

A copying machine 1, which is mounted on a desk 5, is designed to copy an original image on a sheet based on a well-known electrophotographic copying method. Inside the copying machine 1, a photosensitive drum 10, which is placed approximately at the center of the copying machine 1, is driven to rotate in the direction indicated by the arrow (a). First, the photosensitive drum 10 is charged uniformly by an electric charger 11, and then an optical unit 12 is moved in the direction indicated by the arrow (b), whereby the image of an original placed on an original glass table 13 is subjected to a slit exposure to be projected onto the photosensitive drum 10. The electrostatic latent image formed on the photosensitive drum 10 is developed into a corresponding toner image by a magnetic brush type of developing device 14, and then transferred onto a sheet by means of a transfer charger 15.

The photosensitive drum 10 is continued to rotate in the direction of the arrow (a) even after a toner image is transferred so that the residual toner can be removed by a cleaning device 17 with a blade, and simultaneously the residual electric charge is erased by an eraser lamp 18 in order to prepare for the next copying operation.

Copy sheets which are loaded in automatic feeding cassettes 20, 21 and 22 are fed one by one from a selected cassette 20, 21 or 22. Then, a fed sheet is synchronized with a toner image formed on the photosensitive drum 10 by pairs of timing rollers 23, and is transported to a transfer section. After the transfer processing, the sheet is separated from the drum 10 because of the a.c. corona discharge from a separation charger 16 and the stiffness of the sheet itself. Further, the sheet is delivered to a fixing device 25 by a transport belt 24 which is provided with an air suction unit not shown in the drawings, where the toner image is fixed to the sheet, and then the sheet is discharged from the copying machine 1 by pairs of discharge rollers 26.

Meanwhile, below the photosensitive drum 10 is provided a refeeding path 30 through which sheets are fed from a storing/refeeding unit 40 as described in detail later to the timing rollers 23. The refeeding path 30 is composed of pairs of transport rollers 31 and 32 as well as guide plates 33 and 34 disposed adjacent to the rollers 31 and 32. Each copy sheet is fed from the storing/refeeding unit 40 into the refeeding path 30 with the printed side up in a case of duplex copying, or with the printed side down in a case of composite copying, which will be described later. The sheet is transported from the refeeding path 30 to the timing rollers 23 through pairs of rollers 27, and then is supplied to the transfer section.

Figure 4:
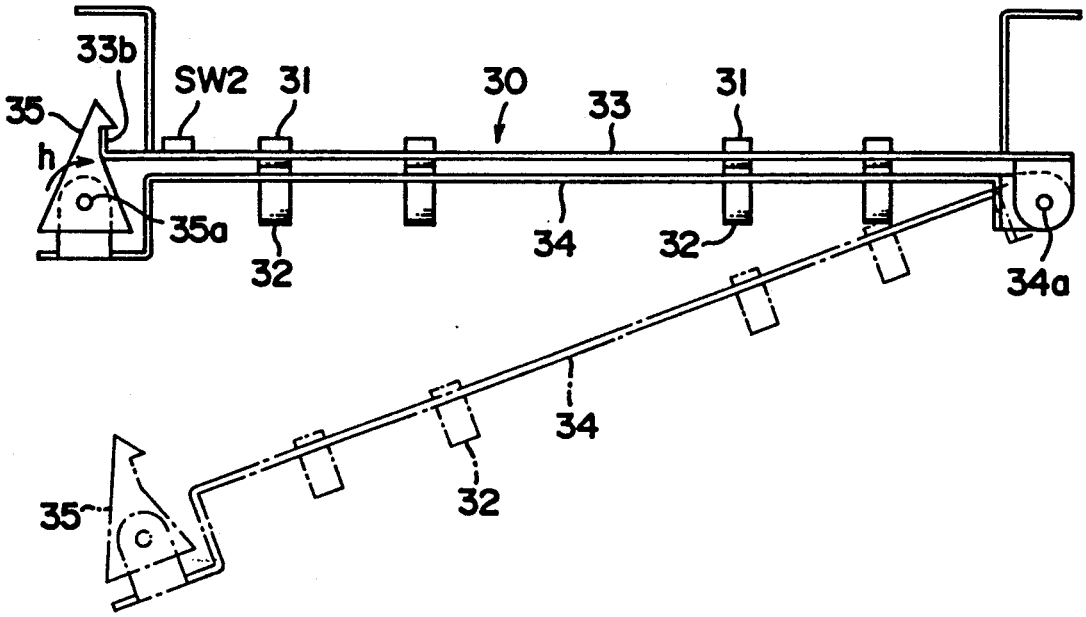
FIG. 4 is a schematic block diagram showing an opening mechanism of a sheet refeeding path in a lower guide plate opening type.
Figure 5:
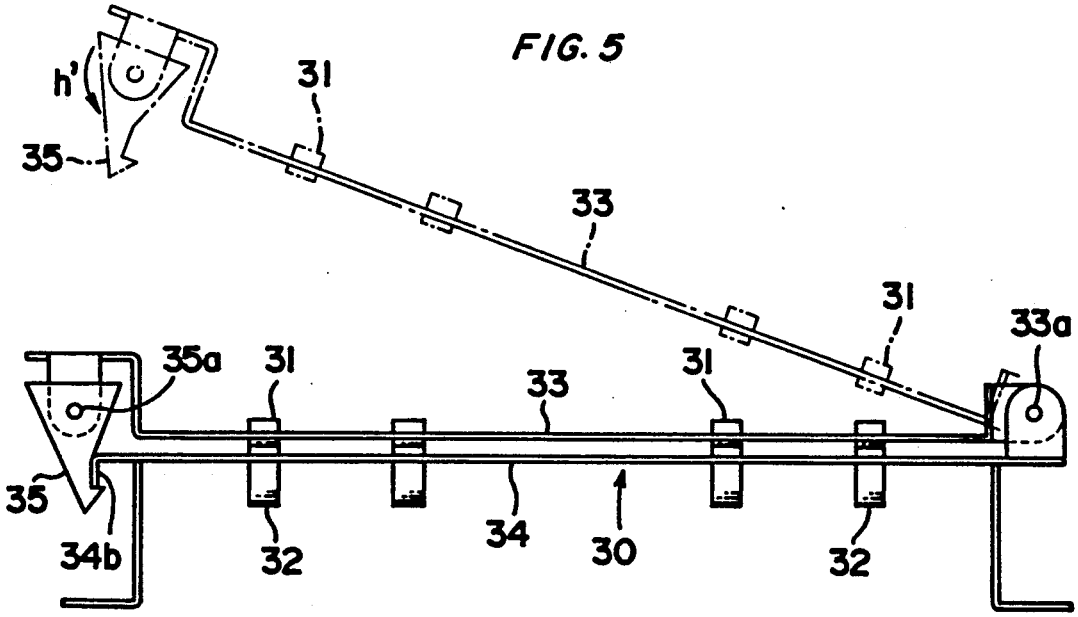
FIG. 5 is a schematic block diagram showing another opening mechanism of the sheet refeeding path in an upper guide plate opening type.

The sheet refeeding path 30 is constructed as an optional unit, and this unit is attached to the copying machine 1 together with the storing/refeeding unit 40, which is an optional unit, too. Since the storing/refeeding unit 40 is attached to a copying machine optionally, it is preferable that the unit 40 fits for any type of copying machine. However, in reference to the space for a sheet refeeding path unit, there is a type of copying machine which has a large space for the upper portion of a sheet refeeding path unit, and another type which has a large space for the lower portion thereof. In this point, it is useful to develop a sheet refeeding path unit into two types as shown in FIGS. 4 and 5. If either one of these types is combined with the storing/refeeding unit 40, an exclusive refeeding path and an exclusive storing/refeeding unit to be provided for a copying machine will be unnecessary.

Either the upper guide plate 33 or the lower guide plate 34 is made to be taken off, so that in case of a sheet jam in the refeeding path 30, the jammed sheet is easily removed. FIG. 4 shows a type of refeeding path whose lower guide plate 34 can be open. In FIG. 4, the lower guide plate 34 is pivoted on a support shaft 34*a* and is capable of moving down to a position as illustrated by the dashed line, while the upper guide plate 33 is fixed. One end of the lower guide plate 34 (front portion of the copying machine 1) is provided with a pawl 35 which is mounted via a pin 35*a* as being urged in the direction of the arrow (h) by a spring member not shown in the drawings. Ordinarily, the pawl 35 engages with one end 33*b* of the upper guide plate 33 to put the rollers 32 in contact with the rollers 31, thereby enabling sheet transport. When the pawl 35 is released from the end 33*b* of the upper guide plate 33, the lower guide plate 34 moves downward on the shaft 34*a* together with the rollers 32 to disclose the refeeding path 30. The open or closed state of the path 30 is judged from the turning-on or turning-off state of a microswitch SW2.

FIG. 5 shows a type of refeeding path whose upper guide plate 33 can be open. In FIG. 5, the upper guide plate 33 is pivoted on a support shaft 33*a* and is capable of moving up to a position as illustrated by the dashed line, while the lower guide plate 34 is fixed. One end of the upper guide plate 33 (front portion of the copying machine 1) is provided with a pawl 35 which is mounted via a pin 35*a* as being urged in the direction of the arrow (h') by a spring member not shown in the drawings. Ordinarily, the pawl 35 engages with one end 34*b* of the lower guide plate 34 to put the rollers 31 in contact with the rollers 32, thereby enabling sheet transport. When the engagement of the pawl 35 is released, the upper guide plate 33 turns upward on the shaft 33*a* together with the upper rollers 31 to disclose the refeeding path 30. In this type, there is provided no switch for detecting the opening and closing action of the upper guide plate 33. This is because the upper guide plate 33 automatically gets back to the set position by its own force of gravity when the operator releases it after removing the jammed sheet. On the contrary, in the foregoing lower guide plate opening type, the lower guide plate 34 must be manually put back to the set position, and therefore detection means (microswitch SW2) for warning the unset condition of the lower guide plate 34 is necessary.

The copying machine 1 is provided with a microswitch SW3 for detecting whether a front door is in an open state or a closed state, while the storing/refeeding unit 40 is provided with a dip switch SW1 (refer to FIG. 1) for changing over the one jam reset manner into another and vice versa. As the reset means, the path open/closed detection switch SW2 is used in one jam reset manner, and the front door open/closed detection switch SW3 is used in another manner. Namely, in applying the upper guide plate opening type of refeeding path as shown in FIG. 5, the dip switch SW1 is set to the on position, and accordingly when the front door open/closed detection switch SW3 is turned on after removing the jammed sheet, the refeeding path 30 is judged to be relieved of the sheet jam and the copying system is reset. In applying the lower guide plate opening type of refeeding path as shown in FIG. 4, the dip switch SW1 is set to the off position, and accordingly when the path open/closed detection switch SW2 is turned on after removing the jammed sheet, the refeeding path 30 is judged to be relieved of the sheet jam, and the copying system is reset. Such a control procedure of recovering from a sheet jam will be described in detail later with reference to flowcharts.

Storing/Refeeding Unit

U.S. patent application Ser. No. 400,736 which was filed on Aug. 30, 1989 discloses the constitution and the operation of the storing/refeeding unit 40, and may be referred to understand the present invention together with the following description.

Basic Constitution

Figure 2:
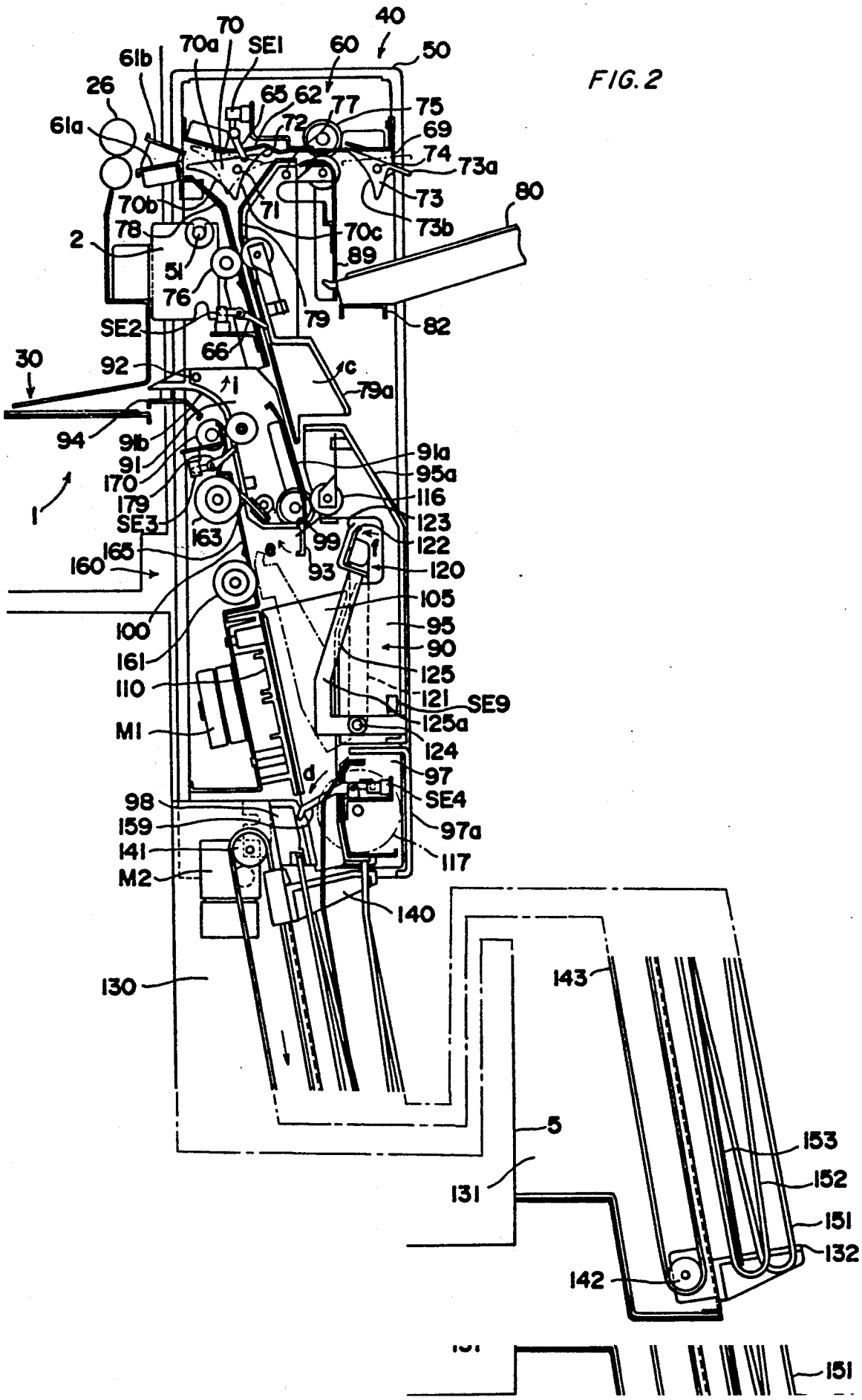
FIG. 2 is an internal composition showing the sheet storing/refeeding unit.

As shown in FIG. 2, the storing/refeeding unit 40 comprises an upper unit 50 having functions of transporting, aligning, and refeeding sheets, and a lower unit 130 having a function of storing sheets.

The storing/refeeding unit 40 can be combined with selectively a sheet tray 80 or a sorter 200. FIG. 2 shows the condition where the storing/refeeding unit 40 is combined with the sheet tray 80. FIG. 1 shows the condition where the unit 40 is combined with the sorter 200. As well-known, the sorter 200 distributes sheets among a total of 20 bins 210 disposed one upon another. When the sorter 200 is used, the sheet tray 80 is placed in the uppermost bin position to function as a sheet tray in a non-sorting mode or as the first bin in a sorting mode.

The storing/refeeding unit 40 comprises a sheet diverter section 60 for changing the transport destination of sheets ejected from the copying machine 1, an intermediate storing section 90 to be temporarily stored with sheets each of which gained an image on one side in the duplex/composite copying mode, and a sheet refeeding section 160 for refeeding the sheets which have been stored in the intermediate storing section 90 toward the refeeding path 30 one after another for the image copying on the other side.

Constitution and Operation of the Diverter Section

The sheet diverter section 60 comprises guide plates 61*a*, 61*b*, and 62, diverter pawls 70 and 73, pairs of ejection rollers 75, pairs of transport rollers 76, guide plates 78 and 79, etc. The diverter pawl 70 has an upper surface 70*a* and arched surfaces 70*b* and 70*c* for guiding sheets. A resin film 72 is adhered to the arched surface 70*c*. The tip portion of the film 72 is in contact with the guide plate 62, so that a sheet coming from the left is guided toward the right in FIG. 2, while a sheet coming from the right is guided toward the arched surface 70*c* of the diverter pawl 70. The diverter pawl 70 is pivoted on a shaft 71 and changed over between a position as illustrated by the solid line and a position as illustrated by the dashed line in FIG. 2 by the turning-on and turning-off operations of a solenoid. The other diverter pawl 73 has an upper surface 73*a* and an arched surface 73*b* for guiding sheets. The diverter pawl 73 is pivoted on a shaft 74 to be changed over between a position as illustrated in the solid line and a position as illustrated in the dashed line by the turning-on and turning-off operations of a solenoid. The rotating direction of the ejection rollers 75 can be changed forward or backward via a clutch by the turning-on and turning-off operations of a solenoid. The guide plate 79 is pivoted on a shaft 77 in the direction of the arrow (c) to open the path for removing the jammed sheet, etc.

The sheet tray 80 is supported on a support plate 82, and in the tray 80, the trailing end of each sheet ejected through the ejection rollers 75 is regulated and aligned by means of a regulation plate 89. When the sheet tray 80 is attached to the storing/refeeding unit 40, the diverter pawl 73 is removed. When the sorter 200 is attached, the sheet tray 80 and the support plate 82 are removed to be replaced by the diverter pawl 73.

At the sheet path composed of the upper surface 70*a* of the diverter pawl 70 and the guide plate 62, and right below the transport rollers 76 in the sheet path composed of the guide plates 78 and 79, photosensors SE1 and SE2 which have actuators 65 and 66 are disposed respectively to detect a sheet passing.

The photosensor SE1 also works as means for resetting the system after removing the sheet jammed in the sheet exit portion. In detail, when a sheet jam takes place near the photosensor SE1, the sensor SE1 maintains the sheet detecting condition (on condition). The jammed sheet can be removed directly from the ejection rollers 75 when the sheet tray 80 is attached. If a sheet jam takes place when the sorter 200 is attached, the jammed sheet can be removed from the ejection rollers 75 by separating the sorter 200 from the storing-/refeeding unit 40. When the jammed sheet is removed and the photosensor SE1 is turned off, the jammed condition is reset by use of turning off signal of the photosensor SE1. The control procedure of reacting to a sheet jam and resetting the system after removing the jammed sheet will be described in detail later with reference to flowcharts.

The following describes the sheet passing form through the diverter section 60.

When a sheet is ejected from the copying machine 1 in the one-sided copying mode or when a double-printed sheet is ejected from the copying machine 1 in the duplex/composite copying mode, the diverter pawls 70 and 73 are set respectively to the positions as illustrated by the solid line and the dashed line, and the ejection rollers 75 rotate forward so as to transport the sheet to the diverter pawl 73. When the sorter 200 is attached, a sheet transported from the copying machine 1 to the diverter section 60 through the ejection rollers 26 is guided by the guide plate 62, the upper surface 70*a* of the diverter pawl 70 and the upper surface 73*a* of the diverter pawl 73, and the sheet is provided with travel force by the ejection rollers 75 to be tranported into the sorter 200. When the sheet tray 80 is attached, the diverter pawl 73 is removed from the storing/refeeding unit 40, and therefore the sheet is ejected from the ejection rollers 75 directly onto the sheet tray 80.

When a sheet which gained an image on one side is ejected from the copying machine 1 in the duplex copying mode, the diverter pawl 70 is set to the position as illustrated by the dashed line, and the sheet is guided by the guide plate 78 and the arched surface 70*b* of the diverter pawl 70 to be transported from the transport rollers 76 toward the intermediate storing section 90 which will be described in detail later.

Further, when a sheet which gained an image on one side is ejected from the copying machine 1 in the composite copying mode, both of the diverter pawls 70 and 73 are set to the positions as illustrated by the solid line, and the ejection rollers 75 are rotated forward. The sheet is guided by the upper surface 70*a* of the diverter pawl 70 and the arched surface 73*b* of the diverter pawl 73. When a certain period has passed since the trailing end of the sheet was detected by the photosensor SE1, the forward rotation of the ejection rollers 75 is stopped. This period corresponds to the time required for the trailing end of the sheet to move from the detection point of the photosensor SE1 to an arbitrary point between the leading end of the film 72 and the ejection rollers 75. Accordingly, the sheet comes to a standstill with its trailing end held by the ejection rollers 75. In the apparatus provided with the sorter 200, when the forward rotation of the ejection rollers 75 is stopped, the leading end of the sheet is guided by the arched surface 73*b* of the diverter pawl 73, the trailing end regulation plate 89, a guide surface 79*a* provided for the guide plate 79, a guide surface 95*a* of the guide frame 95, a guide surface 97*a* of the guide frame 97, and side surfaces of the sorter 200 to be positioned in a space defined by these members.

In the apparatus provided with the sheet tray 80, the sheet is guided onto the sheet tray 80.

Then, the ejection rollers 75 are rotated backward, whereby the sheet whose trailing end is held by the ejection rollers 75 is transported left in FIG. 2, that is, switched back to be transported into the intermediate storing section 90 through the transport rollers 76, guided by the film 72 and the arched surface 70*c* of the diverter pawl 70.

Constitution and Operation of the Intermediate Storing Section

The intermediate storing section 90 is composed of a segment belonging to the upper unit 50 and a segment belonging to the lower unit 130. In detail, the intermediate storing section 90 comprises a frame 91 having a guide surface 91*a*, a guide frame 95, a base plate 100, side regulation plates 105 for regulating both sides of a sheet, a support plate 110 for supporting the side regulation plates 105, guide frames 97 and 98, pairs of storing rollers 116, a paddle wheel 117, a pressure mechanism 120 for pressing the trailing portion of a sheet to be stored therein, a frame 131, a lower regulation plate 140 for regulating the lower edge of a sheet transported thereto, first guide members 151 and 152 made of a wire material, second guide members 153 made of a wire material, a stepping motor M1 for moving the side regulation plates 105 to a proper position for the size of a sheet to be stored therein, and a geared motor M2 for driving the lower regulation plate 140, etc. In the portion where the guide frames 97 and 98 are placed, a photosensor SE4 having an actuator 159 is installed to detect whether or not the intermediate storing section 90 is stored with sheets.

When sheets are to be stored in the intermediate storing section 90, the base plate 100, the support plate 110 and the guide frame 98 compose a sheet supporting surface.

The lower regulation plate 140 functions to regulate the lower edge (the leading end during the travel thereto) of each sheet, and it is fitted to a timing belt 143 laid between a pulley 141 of the geared motor M2 mounted to the frame 131 and a pulley 142 rotatably mounted to the frame 131. The lower regulation plate 140 is movable up and down along the slope of the frame 131 by the forward or reverse rotation of the geared motor M2 to be appropriately positioned in terms of height according to the size of sheets to be collected thereon. The reason why the lower regulation plate 140 is moved in this way according to the size of sheets is that the upper edge of the stacked sheets has to be held at a constant level in preparation for the subsequent sheet refeeding operation. The upper edge level of the sheets is to be a level at which the upper portion of the upright sheet stack is in contact with a refeeding roller 161.

The paddle wheel 117 has a plurality of flexible radial fins around its rotating shaft as being rotatable in the direction of the arrow (d) to exert supplementary transport force to each sheet transported from the storing rollers 116 to the intermediate storing section 90.

Figure 3:
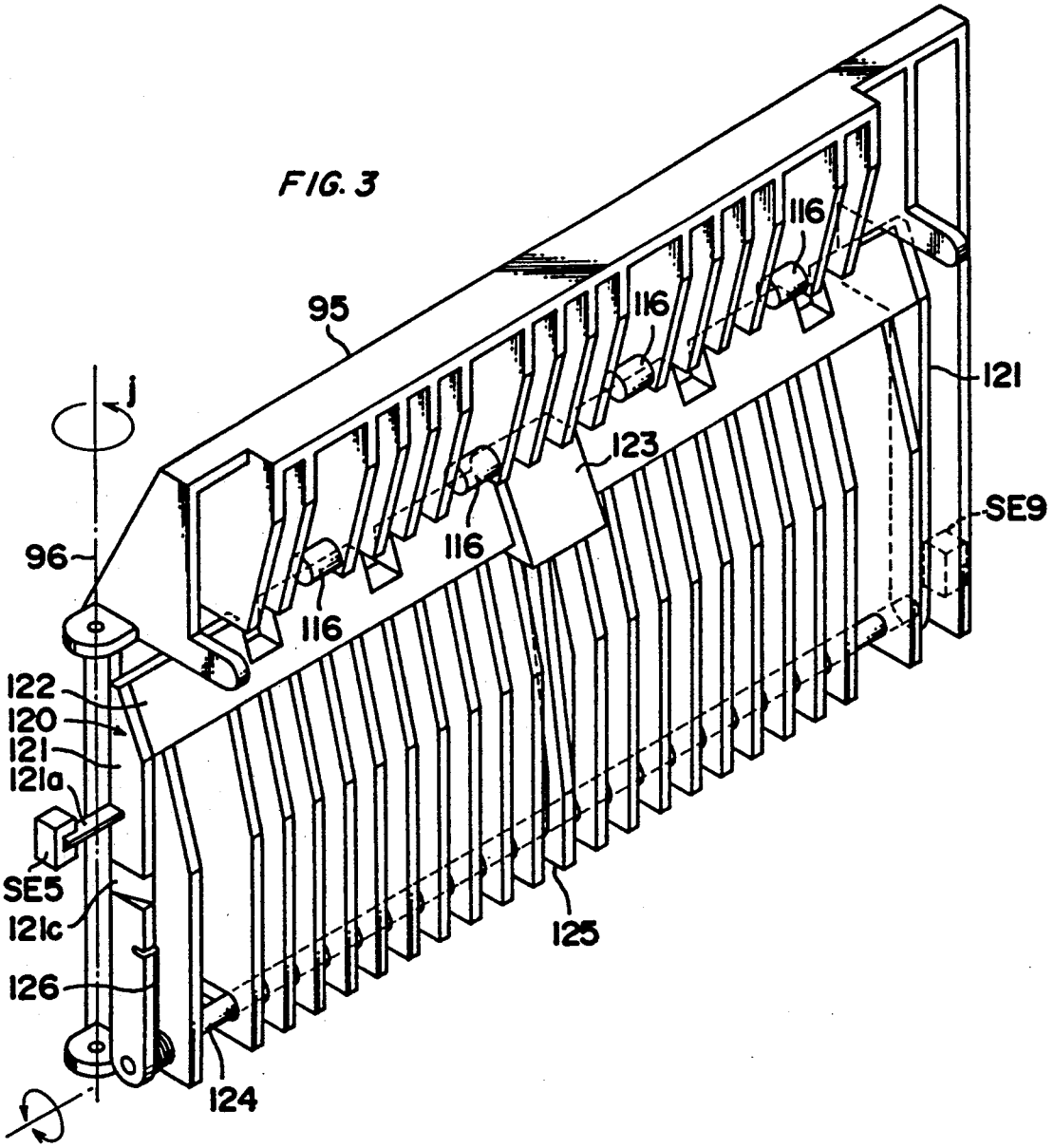
FIG. 3 is a perspective view showing a pressure mechanism and a guide frame.

As shown in FIG. 3, the pressure mechanism 120 comprises arms 121 placed at both sides, a pressure plate 122 fitted to the tip portions of the arms 121, a roller pressure plate 123 fixed to the pressure plate 122 at a position corresponding to that of the refeeding roller 161 as described in detail later, and an arm 125 disposed approximately in center for preventing sheets from bending. The pressure mechanism 120 is pivoted on the guide frame 95 via a shaft 124 supporting the arms 121 and turns between a position as illustrated by the solid line and a position as illustrated by the dashed line in FIG. 2 by the turning-on and turning-off operations of a solenoid. The sheet-bending prevention arm 125 inclines toward the support plate 110 as bending a middle portion 125*a*. The middle portion 125*a* regulates sheets stored therein to prevent the sheets from bending. The arm 125 also functions to stiffen each sheet traveling downward by contact with the sheet.

As shown in FIG. 3, the guide frame 95 supporting the pressure mechanism 120 via its shaft 124 pivots in the direction of the arrow (j) on a shaft 96 fitted to one end thereof, which enables the upper portion of the intermediate storing section 90 to be open. With the opening motion, the pressure mechanism 120 can retreat from the intermediate storing section 90. The arm 121 and the guide frame 95 are connected to each other by a torsion coil spring 126 wound around the shaft 124 to keep the pressure mechanism 120 at a position (home position) as illustrated by the solid line in FIG. 2. A protrusion 121*a* provided for the arm 121 is capable of interrupting the optical axis of a photosensor SE5. Whether the photosensor SE5 is on or off determines whether the pressure mechanism 120 is returned to the home position or driven to the position for pressing the trailing portion of a sheet.

The arrangement of the guide frame 95 to be pivotal together with the pressure mechanism 120 for making the intermediate storing section 90 openable as well as for making the guide plate 79 pivotal via the pin 77 in the direction of the arrow (c) is to facilitate the removal of a jammed sheet by the operator. The guide plate 79 can be reset by its own force of gravity. The guide frame 95 must be closed by the operator after the operator removes the jammed sheet. For this reason, the embodiment employs a photosensor SE9 (refer to FIGS. 2 and 3) for that the guide frame 95 is set. Accordingly, when the photosensor SE9 is turned on upon detection of the set condition of the guide frame 95, a sheet jam reaction resetting operation is carried out in the storing/refeeding unit 40.

The following describes the sheet storing operation.

First, for the preparatory operation, the lower regulation plate 140 is positioned according to the size of a sheet to be stored therein, and the side regulation plates 105 are positioned according to the width of the sheet. At the same time, the pressure mechanism 120 is set to the position as illustrated by the solid line in FIG. 2, and the storing rollers 116 and the paddle wheel 117 are started to rotate.

The sheet, directed downward by virtue of the sheet diverting section 60 and transported from the transport rollers 76, is provided with travel force by the storing rollers 116 toward the intermediate storing section 90. When the leading end of the sheet is detected by the photosensor SE2, the side regulation plates 105 retreat slightly outward from the sheet side regulation position. The sheet is transported into the intermediate storing section 90 as being guided by the separator 93. When a certain period has passed since the trailing end of the sheet traveling toward the intermediate storing section 90 was detected by the photosensor SE2, the side regulation plates 105 are positioned according to the width of the sheet again to align the sheet in the lateral direction. Then the pressure mechanism 120 is pivoted in the direction of the arrow (f) to the position as illustrated by the dashed line and presses the trailing portion of the sheet against the base plate 100.

With the timing control above, each sheet is first aligned in the longitudinal direction, and second aligned in the lateral direction. Finally the trailing end portion is moved toward the base plate 100, whereby a satisfactory sheet alignment can be achieved. Further, every time a sheet is transported into the intermediate storing section 90, the middle portion 125*a* of the arm 125 placed at the center position of the pressure mechanism 120 pushes the sheet to the support plate 110, following the pressing operation and eliminates sheet bending to keep the sheets in a well-regulated condition.

After the first sheet is transported to the intermediate storing section 90 and positioned therein, the pressure mechanism 120 is put back to a position as illustrated by the solid line. When the leading end of the next sheet is detected by the photosensor SE2, the side regulation plates 105 are moved outward again, and the side regulation plates 105 and the pressure mechanism 120 are subsequently driven in the same timing as that of handling the first sheet.

Constitution and Operation of the Refeeding Section

The sheet refeeding section 160 functions to feed sheets, each of which has received an image on one side, out of the intermediate storing section 90 into the refeeding path 30 in the copying machine 1 one after another in the same order as transported to the intermediate storing section 90, when a sheet refeeding signal is generated. More specifically, as shown in FIG. 2, the sheet refeeding section 160 comprises the base plate 100 which is also used as a receiving surface in the intermediate storing section 90, a refeeding roller 161 and a separation roller 163 which are intermittently driven by a clutch to rotate, a separation pad 165 made of urethane rubber to be abutted to the separation roller 163, pairs of register rollers 170 intermittently driven by a clutch to rotate, etc. The sheet path leading to the refeeding path 30 is formed of a guide surface 91*b* of the guide frame 91 and a guide plate 94. In front of the register rollers 170, a photosensor SE3 having an actuator 179 is installed. Further, the guide frame 91 is made pivotal in the direction of the arrow (i) to open the sheet path for removing a jammed sheet, etc.

When a copying signal is generated to require sheet refeeding, first, the pressure mechanism 120 is driven to press the upper portion of the sheets. In a little while from the sheet pressing timing, the refeeding roller 161 and the separation roller 163 are started to rotate to feed upward the sheet which is in contact with the refeeding roller 161. The sheet that has reached the nip portion of the separation roller 163 and the separation pad 165 is fed to the register rollers 1/0. At this time, even if a plurality of sheets are fed out simultaneously, only one of the sheets which is in contact with the separation roller 163 is fed to the register rollers 170. When a certain period has passed since the leading end of the sheet was detected by the photosensor SE3, the register rollers 170 arc driven to rotate. The pressure mechanism 120 is moved backward when the leading end of the sheet is detected by the photosensor SE3, whereby the sheet remaining at the nip portion of the separation roller 163 and the separation pad 165 falls down to be put back to the original storing position.

After the register rollers 170 are driven to rotate at the above-mentioned timing, the sheet is fed upward by the rollers 170, and then guided by the guide surface **91*b* and the guide plate 94 to the refeeding path 30 in the copying machine 1. The rotations of the refeeding roller 161 and the separation roller 163 are once stopped, a moment after the register rollers 170 were started to rotate. It is noted that the rollers 161 and 163** rotate following the feeding motion of the sheet because they are fitted around the shafts via one-way bearings.

The sheet refeeding operation for the second and successive sheets is performed as follows. When a certain sheet refeeding period corresponding to the sum of the sheet length and a certain length (margin length) has passed since the leading edge of the previous sheet was detected by the photosensor SE3, the pressure mechanism 120 is driven again to press the leading portion of the next sheet. When the trailing edge of the previous sheet is detected by the photosensor SE3, the refeeding roller 161 and the separation roller 163 are driven to rotate again to repeat the same operation as for the first sheet as described above.

When it is detected by the photosensor SE4 that all the sheets in the intermediate storing section 90 have been refed out thereof, the lower regulation plate 140 and the side regulation plates 105 are put back to the respective home positions.

Control Circuitry

Figure 6:
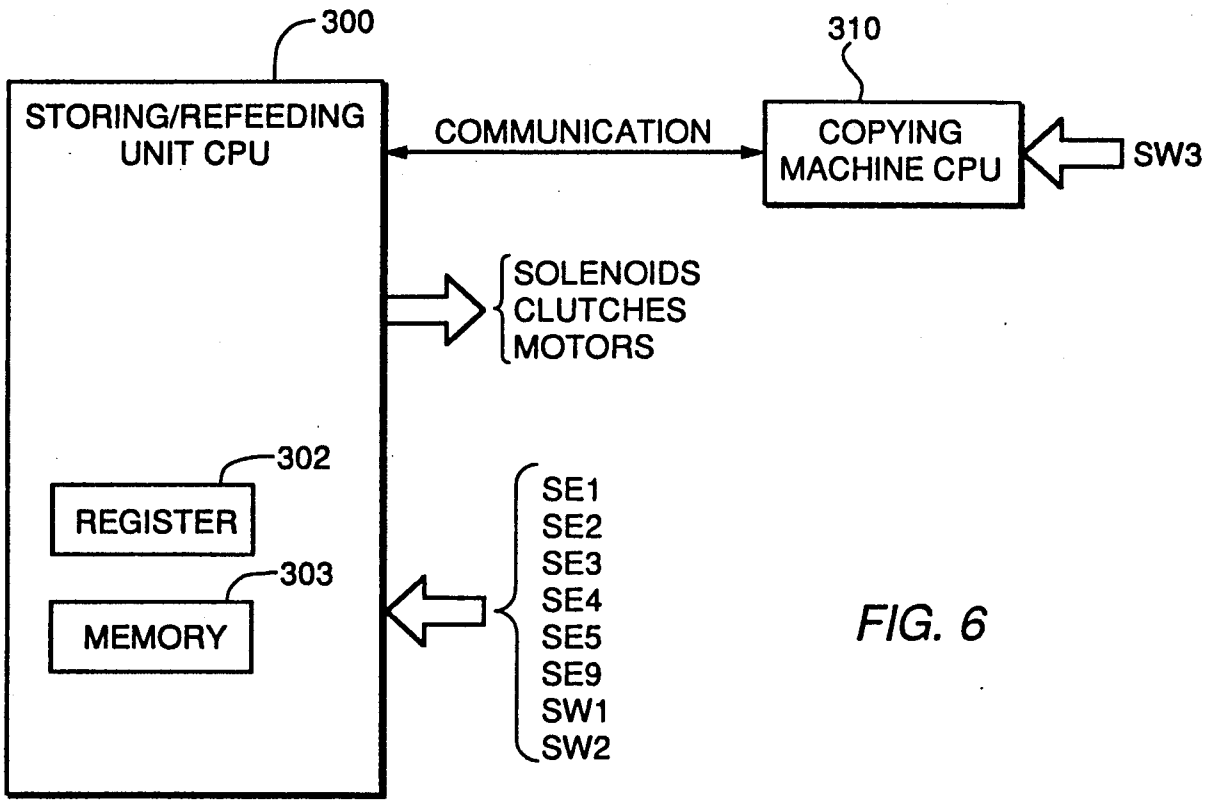
FIG. 6 is a diagram showing a control circuitry.

A control circuitry of the storing/refeeding unit 40 which has the above-mentioned constitution and operates above is explained referring to FIG. 6.

The system control is performed mainly by a computer 300 (which is hereinafter referred to as CPU). The CPU 300 comprises a register 302, a memory 303, etc., and it is communicable with a CPU 310 of the copying machine 1.

On and off signals from the sensors SE1 through SE5 and SE9 and switches SW1 and SW2 are entered into each input port. The optical axes of the sensors SE1 through SE4 are interrupted by respective actuators to produce off signals when the sensors detect no sheet, and the off signals are changed to on signals when the sensors detect a sheet. The sensors SE5 and SE9 produce the on signals when the optical axes are interrupted by the respective actuator, and the off signals are changed to the on signals when the sensors are relieved of the interruptions.

From output ports, on and off signals are sent to the solenoids, clutches and motors for driving the respective members. The CPU 310 of the copying machine 1 is connected to the microswitch SW3 for detecting the open or the closed state of the front door.

Control Procedure

The following describes the control procedure of the storing/refeeding unit 40 performed by the CPU 300 with reference to FIGS. 7 through 10.

In the following paragraphs, the term "on-edge" is defined as a change in status, where the switch, sensor, signal or the like changes from the off status to the on status. In contrast, the term "off-edge" represents a change in status, where the switch, sensor, signal or the like changes from the on status to the off status.

Figure 7:
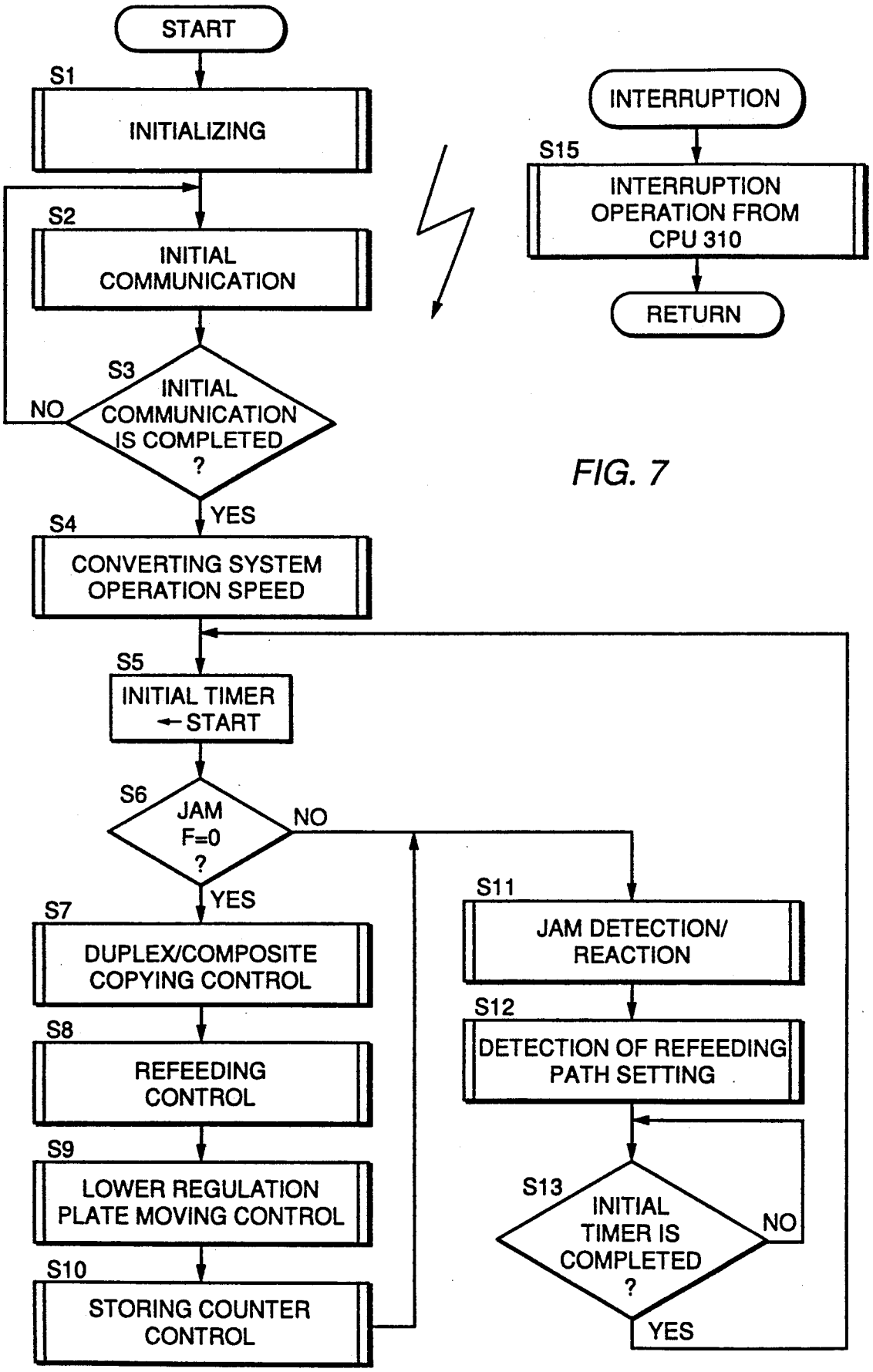
FIG. 7 is a flowchart showing a main routine carried out by a microcomputer for the sheet storing/refeeding unit.

FIG. 7 is a flowchart showing the main routine carried out by the CPU 300.

When the CPU 300 is reset to start the program, the data in a random access memory 303 is cleared, the register 302, etc. are initialized, and each device is set to the initial mode at step S1. Then an initial communication with the CPU 301 of the copying machine 1 is performed at step S2. When it is confirmed at step S3 that necessary communication data for the control of the storing/refeeding unit 40 has been received, a subroutine for converting the system operation speed is performed at step S4. At this step S4, the system operation speed of the copying machine 1 transmitted from the CPU 310 at step S2 is read in order to convert the data to the value of sheet transport per one count of an internal timer.

Then, the internal timer is started at step S5. The internal timer was already set at step S1 to determine a time required for one cycle of the main routine performed by the CPU 300, and it becomes a reference for one count of a timer for each subroutine as described later.

Then it is judged at step Sl whether a jam flag is "0". The jam flag is set to "1" when a sheet jam takes place in the storing/refeeding unit 40 or in the refeeding path 30 (refer to step S346). Therefore, when the jam flag indicates "1", the processing directly goes to step S11. When the jam flag is "0", each of subroutines S7 through S12 are called successively. When the processing goes through all the subroutines, the processing returns to step S5 after confirming the completion of the internal timer at step S13. At step S7, the processing follows a subroutine for the duplex/composite copying control wherein the pawls 70 and 73, the lower regulation plate 140, the side regulation plates 105, etc. are controlled in accordance with the duplex copying mode or the composite copying mode, and sheets each of which has received an image on one side are ejected one after another from the copying machine 1 to the intermediate storing section 90. At step S8, the processing follows a subroutine for the sheet refeeding control wherein the refeeding roller 161, the register roller 170, the pressure mechanism 120, etc. are controlled based on a sheet refeeding signal, and sheets each of which has received an image on one side are refed one after another from the intermediate storing section 90 back to the copying machine 1. A subroutine for moving the lower regulation plate 140 to the regulating position or returning to the home position is executed at step S9. A subroutine to be performed at step S10 is for counting the number of sheets stored in the intermediate storing section 90. The subroutines to be executed at steps S11 and S12 will be described in detail later.

When an interruption demand is generated from the CPU 310 of the copying machine 1, an interruption operation is performed according to the data transmitted at step S15.

Figure 8:
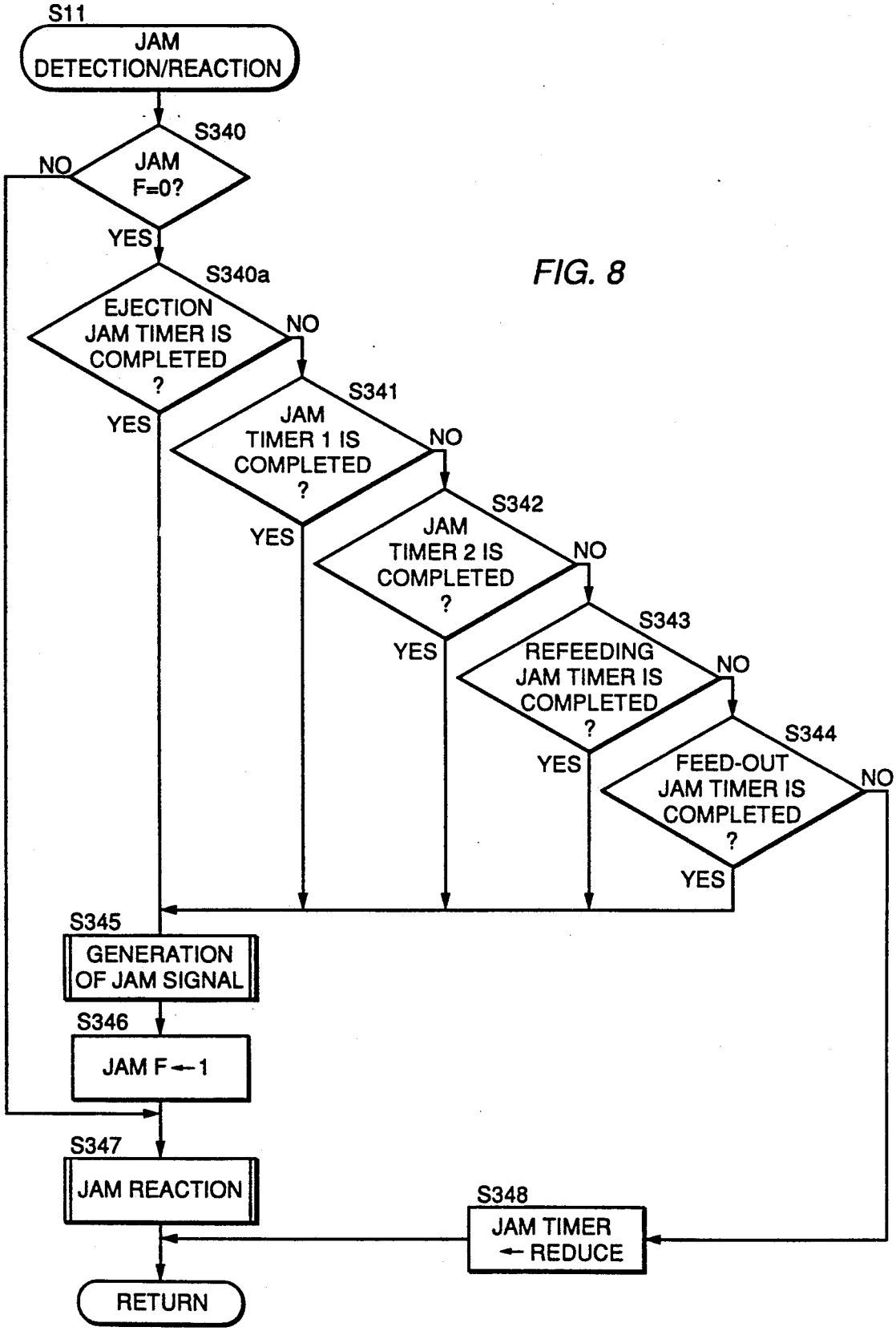
FIG. 8 is a flowchart showing a subroutine for detecting a sheet jam and reacting to it.

FIG. 8 is a flowchart showing a subroutine for detecting a sheet jam and reacting to it, which is performed at step S11. In this subroutine, when a sheet jam is detected occurring in any section of the storing/refeeding unit 40, an alarm and a designation for removing the jammed sheet are dispatched.

First, it is judged at step S340 whether the jam flag is "0". The jam flag represents the occurrence of a sheet jam when it is set to "1". Therefore, when it has been set to "1", the processing immediately proceeds to step S347. When the jam flag is "0", it is judged at steps S340*a* and S341 through S344 whether or not there occurred a sheet jam in each section, and the count of a jam timer is reduced at step S348. More specifically, at step S340*a*, the occurrence of a sheet jam in the neighborhood of the ejection rollers 75 is judged from the completion of an ejection jam timer. The ejection jam timer works with the sensor SE1 in an ejection mode, and when a sheet does not pass through the sensor SE1 within a specified period (corresponding to the length of the sheet and a margin), it is judged that a sheet jam has occurred in this area. At steps S341 and S342, it is checked the occurrence of a sheet jam around the entrance of the intermediate storing section 90 during a sheet storing operation, based on the counts of jam timers 1 and 2. When the jam timer 1 finishes counting, it is judged that the pressing mechanism 120 is not working although the solenoid was turned on. Similarly, when the jam timer 2 finishes counting, it is judged that the pressing mechanism 120 has not returned to the home position although the solenoid was turned off. In these cases, it is judged that a sheet jam has occurred in the neighborhood of the entrance of the intermediate storing section 90. The occurrence of a sheet jam in the neighborhood of the exit of the intermediate storing section 90 during a sheet refeeding operation is also checked at steps S343 and S344, based on the counts of a refeeding jam timer and a feed-out jam timer. The refeeding jam timer works with the sensor SE3, and when the leading edge of a sheet does not reach the detection point of the sensor SE3 within a specified period, it is judged that a sheet jam has taken place around the refeed roller 161 and the separation roller 163. The feed-out jam timer works with the sensor SE3, and when a sheet does not pass through the sensor SE3 within a specified period (corresponding to the length of the sheet and a margin), it is judged that a sheet jam has taken place in this area. When a sheet jam takes place at any section, a jam signal is generated at step S345. In this procedure, the jam signal upon the detection of a sheet jam at any step of S340*a* and S341 through S344 is transmitted to the CPU 310 of the copying machine 1. Then the jam flag is set to "1" at step S346, and the subroutine for reacting to a sheet jam is performed at step S341.

Further, the occurrence of a sheet jam in the refeeding path 30 is checked by a combination of a sheet detection sensor and a timer. When a sheet jam occurs, the jam signal is transmitted to the CPU 310.

Figure 9:
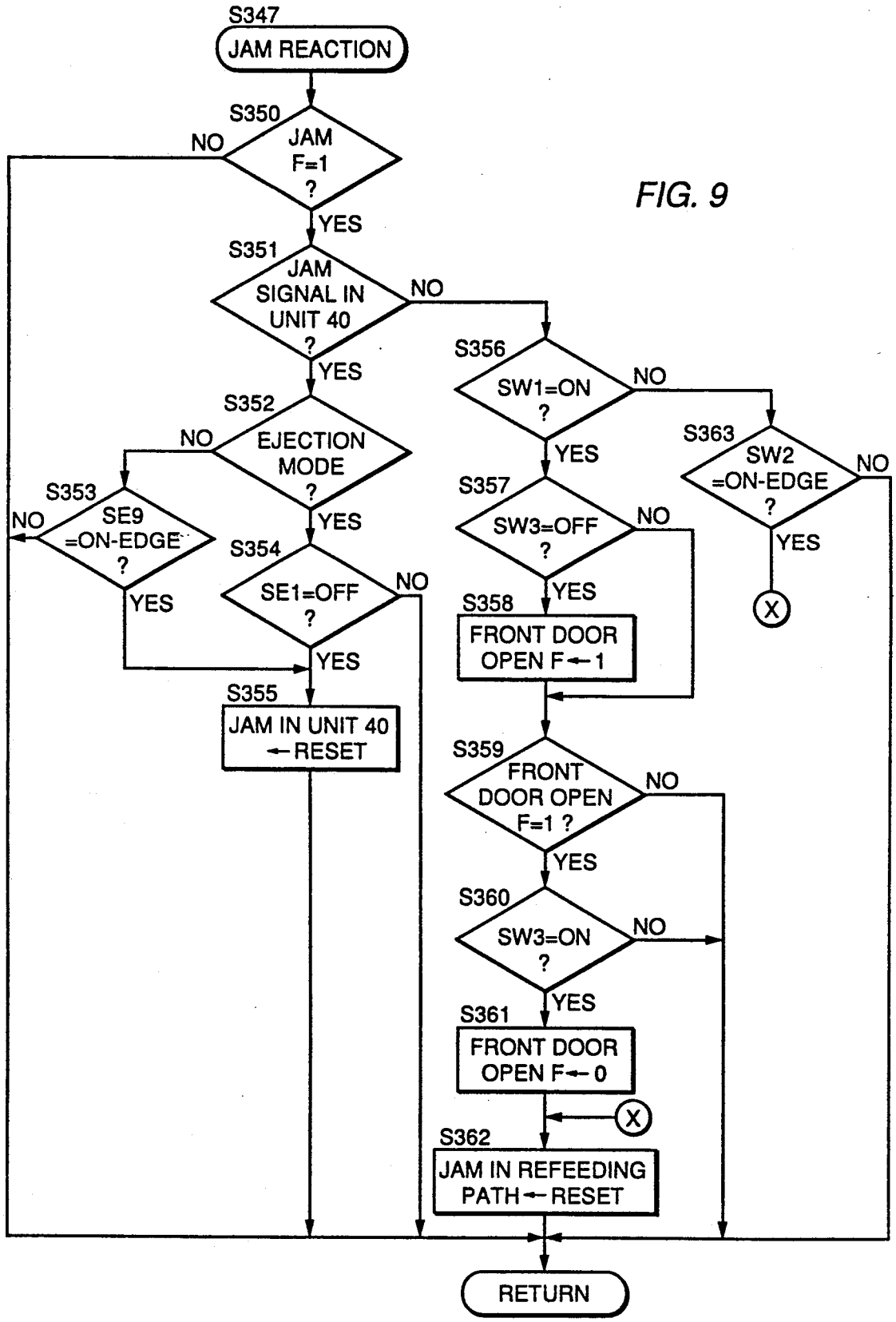
FIG. 9 is a flowchart showing a subroutine for reacting to a sheet jam.

FIG. 9 is a flowchart showing a subroutine for reacting to a sheet jam to be performed at step S347.

In this subroutine, after confirming at step S350 that the jam flag has been set to "1" (which indicates the occurrence of a sheet jam), it is checked at step S351 whether or not the jam signal represents the occurrence of a sheet jam inside the storing/refeeding unit 40. When there occurred a sheet jam in the unit 40, it is checked at step S352 whether the operation mode is the ejection mode or not. The ejection mode is a mode wherein sheets are ejected from the ejection rollers 75 to the sheet tray 80 or the sorter 200. Therefore, when the unit 40 is not operated in the ejection mode, that is, when the unit 40 is operated in the storing/refeeding mode, it is checked at step S353 whether the photosensor SE9 is on-edge or not. When the photosensor SE9 is on-edge, it is judged that the sheet jam has been managed, that is, the jammed sheet has been removed and that the guide frame 95 is closed by the operator, and a sheet jam reaction resetting operation in the storing/refeeding unit 40 is performed at step S355. In the operation, the jam signal is restored to the normal condition, and the counter, flag, etc. are reset. When it is judged at step S352 that the current operation mode is the ejection mode, at step S354, the photosensor SE1 is checked whether off or not. When the photosensor SE1 has been just turned off, it is judged at step S355 that the jammed sheet has been removed from the ejection rollers 75 by the operator, and the jam reaction resetting operation is performed.

On the other hand, when the result at step S351 is negative, that is, when the sheet jam is taking place in the refeeding path 30, it is judged at step S356 whether the dip switch SW1 is on or not. When the dip switch SW1 is on, the refeeding path 30 is of the upper guide plate opening type as shown in FIG. 5, so that the open or closed state of the front door is judged by the on or off status of the microswitch SW3 at step S357. The signal from the microswitch SW3 is entered into the CPU 310 of the copying machine 1, and the open or closed state of the front door is judged by a data exchange between the CPU 310 and the CPU 300. When the microswitch SW3 is off, a front door open flag is set to "1" at step S358. When it is confirmed at step S359 that the front door open flag has been set to "1", the on or off status of the microswitch SW3 is checked again at step S360. When the microswitch SW3 is turned on, it is judged that the jammed sheet has been removed by the operator and that the front door is closed. Then the front door open flag is reset to "0" at step S361, and the jam reaction resetting operation in the refeeding path 30 is performed at step S362. In this operation, the jam signal is restored to the normal condition, and the counter, flag, etc. are reset.

When it is judged at step S356 that the dip switch SW1 is off, the refeeding path 30 is of the lower guide plate opening type as shown in FIG. 4, so that the microswitch SW2 is checked at step S363 whether on-edge or not. As mentioned above, the microswitch SW2 is turned on when the lower guide plate 34 is set. Therefore, when the microswitch SW2 is on-edge, it is judged that the jammed sheet has been removed by the operator and that the lower guide plate 34 is closed, and the jam reaction resetting operation in the refeeding path 30 is performed at step S362.

Figure 10:
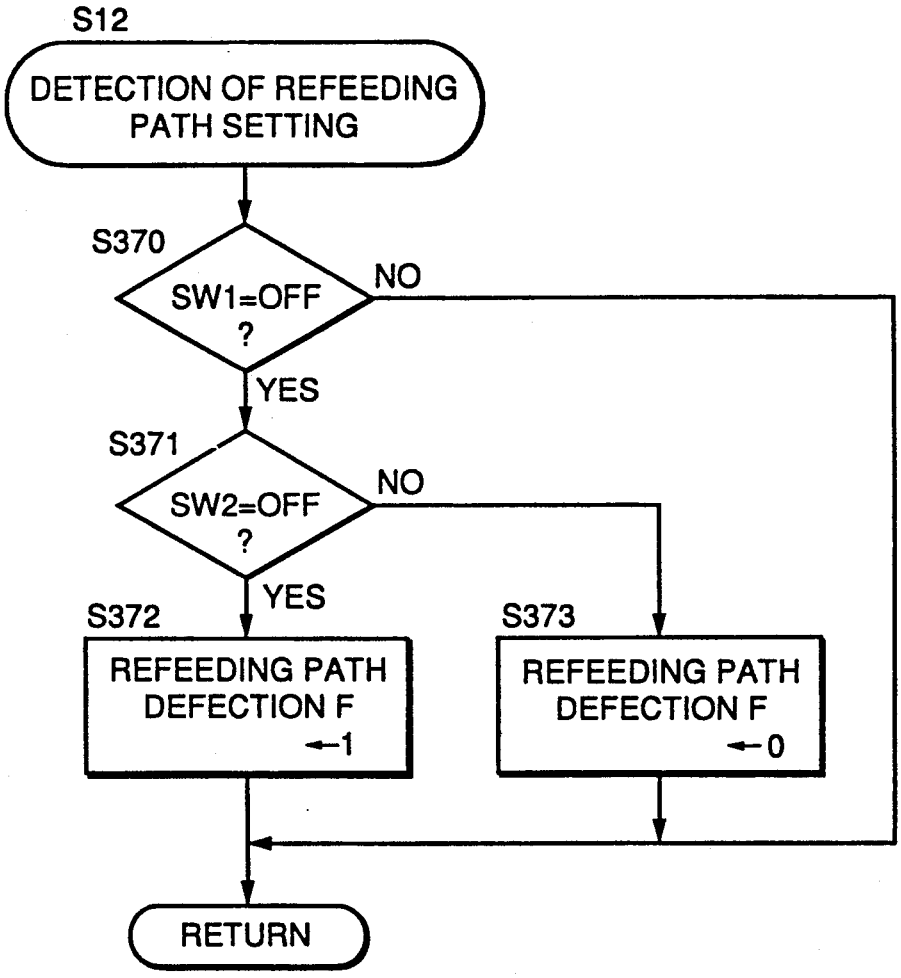
FIG. 10 is a flowchart showing a subroutine for detecting the refeeding path being set.

FIG. 10 is a flowchart showing a subroutine for detecting the refeeding path 30 being set, which is performed at step S12.

First, at step S370, the dip switch SW1 is checked whether off or not. When the dip switch SW1 is off, the refeeding path 30 is the lower guide plate opening type as shown in FIG. 4, so that the open or closed state of the lower guide plate 34 is judged by the on or off status of the microswitch SW2 at step S371. When the microswitch SW2 is off and the lower guide plate 34 is open, a refeeding path defection flag is set to "1" at step S372. When the defection flag is set to "1", the copying operation is inhibited. Then when the microswitch SW2 is on and the lower guide plate 34 is closed, the refeeding path defection flag is reset to "0" at step S373.

With the control above, the sheet refeeding operation is never performed with the refeeding path 30 open, which effectively prevents a sheet jam.

In addition, when the microswitch SW2 is not installed in the copying machine 1, a signal representing the on status of the microswitch SW2 is entered into the CPU 300 through the port for the microswitch SW2 in order to prevent erroneous detection.

Although the present invention has been described in connection with the preferred embodiment thereof, it is to be noted that various changes and modifications are apparent to those who are skilled in the art. Such changes and modifications are to be understood as being within the scope of the present invention as defined by the appended claims, unless they depart therefrom.

The stacking posture of sheets in the intermediate storing section 90 may be approximately horizontal instead of the aforesaid approximately vertical posture, and the horizontal type of storing unit may be incorporated into the body of the copying apparatus.

Also, the sheet storing unit in the embodiment above has a sheet refeeding function, but there may be alternative functions such as a sheet stapling function, a sheet clipping function and so on.

Further, means for detecting the refeeding unit being set is not limited to the microswitch SW2, and it may be a switch for detecting the storing/refeeding unit 40 being open or being separated from the copying machine 1.

What is claimed is:

1. An image forming apparatus comprising:

an image forming section where an image is formed on a sheet;

a sheet handling section for receiving printed sheets from the image forming section, said sheet handling section being operable in an ejection mode of ejecting printed sheets outside and in a mode of collecting printed sheets inside thereof to process the sheets;

means provided in the sheet handling section for detecting a sheet, which means is disposed in a sheet path taking sheets outside said sheet handling section;

means for detecting the occurrence of a sheet jam at each part in the sheet handling section;

means for reacting to a sheet jam by discontinuing the operation of the apparatus in response to a jam signal generated from the sheet jam detecting means; and means for resetting the sheet jam reaction, when the apparatus is relieved of the sheet jam, by canceling the discontinuance of the operation of the apparatus in accordance with the operation mode in which the sheet handling section was operated before the discontinuance, wherein when the operation mode of the sheet handling section before the discontinuance is the ejection mode, the jam reaction resetting operation is executed in response to a signal indicating that the sheet detecting means does not detect a sheet after the jam reacting operation.

2. An image forming apparatus as claimed in claim 1, further comprising a switch operating with regard to a jammed sheet removing operation, wherein the sheet jam reaction resetting means operates in reference to the operation of the switch.

3. An image forming apparatus as claimed in claim 2, wherein the switch detects a member having an open state and a closed state, said member to be in said open state during a jammed sheet removing operation

4. An image forming apparatus comprising:

a sheet path located inside the image forming apparatus, said sheet path being openable so that a jammed sheet can be removed therefrom;

an outside cover having an open state so that an operator can gain access to the sheet path, and a closed state;

means for detecting whether the outside cover is in said open state or said closed state;

means for detecting the occurrence of a sheet jam at each part in the sheet path;

means for reacting to a sheet jam by discontinuing the operation of the apparatus in response to a jam signal generated from the sheet jam detecting means;

means for resetting the sheet jam reaction, when the apparatus is relieved of the sheet jam, by canceling the discontinuance, said resetting means being operable in a first jam reaction reset mode wherein the jam reaction resetting operation is executed in response to an outside cover close signal generated from the outside cover detecting means, and in a second jam reaction reset mode wherein the jam reaction resetting operation is executed in response to the recovery of the sheet path from the sheet jam; and means for selecting either the first jam reaction reset mode or the second jam reaction reset mode in advance.

5. An image forming apparatus as claimed in claim 4, wherein the sheet path has an upper guide member and a lower guide member, and the sheet path is also of either a type whose upper guide member is openable upward, or a type whose lower guide member is openable downward and is provided with a switch for detecting that the lower guide member is put in a closed state.

* * * * *

UNITED STATES PATENT AND TRADEMARK OFFICE

CERTIFICATE OF CORRECTION

PATENT NO. : 5,010,363

DATED : April 23, 1991

INVENTOR(S) : Kimihiko Higashio, et al.

It is certified that error appears in the above-identified patent and that said Letters Patent is hereby corrected as shown below:

In col. 1, line 22, change "Limer" to --timer--.

In col. 9, line 55, after "for" insert --detecting--.

In col. 11, line 2, change "1/0" to --170--.

In col. 13, line 55, change "S341" to --S347--.

In the Abstract paragraph, line 15 thereof, change "react" to --reset--.

Signed and Sealed this

Sixth Day of October, 1992

*Attest:*

DOUGLAS B. COMER

*Attesting Officer*

*Acting Commissioner of Patents and Trademarks*